US009782008B2

(12) United States Patent
Slongo et al.

(10) Patent No.: US 9,782,008 B2
(45) Date of Patent: Oct. 10, 2017

(54) CHAIR BACK HEIGHT ADJUSTMENT MECHANISM AND CHAIR

(71) Applicant: L&P PROPERTY MANAGEMENT COMPANY, South Gate, CA (US)

(72) Inventors: Alessandro Slongo, Mogliano Veneto (IT); Mark Grant Jones, Chorley (GB); Nigel Charles Fitzsimmonds, Silsden (GB)

(73) Assignee: L&P Property Management Company, South Gate, CA (US)

( * ) Notice: Subject to any disclaimer, the term of this patent is extended or adjusted under 35 U.S.C. 154(b) by 192 days.

(21) Appl. No.: 14/762,714

(22) PCT Filed: Jan. 21, 2014

(86) PCT No.: PCT/EP2014/051102

§ 371 (c)(1),
(2) Date: Jul. 22, 2015

(87) PCT Pub. No.: WO2014/114629

PCT Pub. Date: Jul. 31, 2014

(65) Prior Publication Data

US 2015/0366354 A1 Dec. 24, 2015

(30) Foreign Application Priority Data

Jan. 23, 2013 (EP) ..... 13000335

(51) Int. Cl.
*A47C 7/40* (2006.01)

(52) U.S. Cl.
CPC ..... *A47C 7/402* (2013.01)

(58) Field of Classification Search
CPC ..... A47C 7/402
See application file for complete search history.

(56) References Cited

U.S. PATENT DOCUMENTS 3,295,888 A * 1/1967 Poland ..... A47C 7/402 297/298
3,467,352 A * 9/1969 Bohler ..... A47C 3/28 248/125.1

(Continued)

FOREIGN PATENT DOCUMENTS

CN 2482347 Y 3/2002
CN 101288533 A 10/2008

(Continued)

OTHER PUBLICATIONS

International Search Report with Written Opinion dated Feb. 17, 2014 in Application No. PCT/EP2014/051102, 9 pages.

*Primary Examiner* — Timothy J Brindley
(74) *Attorney, Agent, or Firm* — Shook Hardy & Bacon, L.L.P.

(57) ABSTRACT

A chair back height adjustment mechanism comprises a guide having an abutment surface at a lateral side of the guide which extends along an adjustment direction. The chair back height adjustment mechanism comprises an adjusting device supported on the guide so as to be displaceable along the adjustment direction. The adjusting device comprises a carrier, a coupling member which is moveably supported on the carrier, and a bias mechanism. The coupling member has a contact face shaped to abut on the abutment surface of the guide and a slanted face. The bias mechanism is operative to apply a force onto the slanted face to urge the contact face of the coupling member against the abutment surface of the guide.

16 Claims, 9 Drawing Sheets

(56) References Cited

U.S. PATENT DOCUMENTS

| | | | | |
|---|---|---|---|---|
| 3,467,532 | A | 9/1969 | Bohler | |
| 4,012,158 | A * | 3/1977 | Harper | A47C 7/402 248/408 |
| 4,662,682 | A * | 5/1987 | Maurel | A47C 7/402 297/353 |
| 5,586,809 | A * | 12/1996 | Szmadzinski | A47C 7/402 297/353 |
| 5,597,204 | A * | 1/1997 | Karaus, Jr. | A47C 7/402 297/353 |
| 5,791,734 | A * | 8/1998 | Malenotti | A47C 7/402 248/297.31 |
| 5,882,077 | A | 3/1999 | Gebhard | |
| 6,276,757 | B1 * | 8/2001 | Brown | A47C 7/402 297/353 |
| 6,299,253 | B1 * | 10/2001 | Chen | A47C 7/402 297/353 |
| 6,540,296 | B1 | 4/2003 | Shats et al. | |
| 9,247,821 | B1 * | 2/2016 | Wu | A47C 7/402 |
| 2003/0071506 | A1 * | 4/2003 | Burgin | A47C 7/402 297/353 |
| 2004/0061368 | A1 * | 4/2004 | Lin | A47C 7/402 297/353 |
| 2005/0017560 | A1 * | 1/2005 | Bastas | A47C 7/402 297/353 |
| 2006/0226684 | A1 * | 10/2006 | Wu | A47C 7/54 297/300.1 |
| 2006/0232115 | A1 * | 10/2006 | Chi | A47C 7/402 297/301.1 |
| 2010/0090512 | A1 * | 4/2010 | Hu | A47C 7/402 297/353 |
| 2011/0085851 | A1 * | 4/2011 | Tsai | A47C 7/402 403/322.1 |
| 2011/0215623 | A1 * | 9/2011 | Tsai | A47C 7/46 297/301.1 |
| 2015/0272334 | A1 * | 10/2015 | Gloeckl | A47C 7/443 297/284.7 |

FOREIGN PATENT DOCUMENTS

| | | | |
|---|---|---|---|
| CN | 203153101 | U | 8/2013 |
| DE | 4028481 | A1 | 3/1992 |
| FR | 765145 | A | 6/1934 |
| JP | S4429543 | Y | 12/1969 |
| JP | S486010 | U | 1/1973 |

* cited by examiner

CHAIR BACK HEIGHT ADJUSTMENT MECHANISM AND CHAIR

CROSS-REFERENCE TO RELATED APPLICATIONS

This application claims priority under 35 U.S.C. §365 to PCT/EP2012/004402, filed on Jan. 21, 2014, entitled "Chair Back Height Adjustment Mechanism and Chair," and European Patent Application No. EP13000335.3, filed Jan. 23, 2013, entitled "Chair Back Height Adjustment Mechanism and Chair," the entirety of the aforementioned applications are incorporated by reference herein.

FIELD OF THE INVENTION

The invention relates to a chair back height adjustment mechanism for a chair and to a chair. The invention relates in particular to a chair back height adjustment mechanism which comprises a guide member along which the chair back may be displaced.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. Such chairs may include a chair back height adjustment mechanism which allows a height of the chair back to be adjusted.

The chair back height adjustment mechanism may have a guide and an adjusting device which is moveably supported thereon. The guide may be shaped as a so-called J-bar, for example, which extends upward at a rear side of the seat. An adjusting device acts as backrest carrier and is moveably supported on the guide. The height of the chair back may be adjusted by adjusting the position of the adjusting device on the guide.

An example for a height adjustment mechanism having such a configuration is described in U.S. Pat. No. 7,275,790 B2, for example.

In this type of chair back height adjustment mechanisms, the guide has a high strength or is attached to a separate carrier which has high strength, so as to support the forces acting onto the chair back. To this end, the guide may be formed from or may comprise a steel bar, for example. It is challenging to manufacture a combination of guide and adjusting device such that the inner dimensions of the adjusting device match the outer dimensions of the guide, at least in a lateral, i.e. left-right, direction. Reducing the manufacturing tolerances for the high strength part of the guide would address this problem, but would significantly add to the complexity of the manufacturing process and, thus, manufacturing costs. The adjusting device may be provided with an oversized inner cavity which is sufficiently large to allow the guide to pass therethrough, taking into consideration the manufacturing tolerances for the guide. This may give rise to a wobble of the adjusting device on the guide, which in turn gives rise to a wobble of the chair back. Such a wobble or play is generally undesired.

BRIEF SUMMARY OF THE INVENTION

There is a continued need in the art for a chair back height adjustment mechanism and a chair which address some of the above needs. In particular, there is a continued need in the art for a chair back height adjustment mechanism which reduces undesired lateral movement of the chair back which is caused by variations in outer dimensions of a guide member, such as a J-bar.

According to embodiments, a chair back height adjustment mechanism and a chair as defined in the claims are provided. The dependent claims define further embodiments.

According to an embodiment, a chair back height adjustment mechanism comprises a guide and an adjusting device. The guide has an abutment surface at a lateral side of the guide, with the abutment surface extending along an adjustment direction. The adjusting device is supported on the guide so as to be displaceable along the adjustment direction. The adjusting device comprises a carrier, a coupling member, and a bias mechanism. The coupling member is moveably supported on the carrier and has a contact face shaped to abut on the abutment surface of the guide and a slanted face. The bias mechanism is operative to apply a force onto the slanted face to urge the contact face of the coupling member against the abutment surface of the guide.

The slanted face of the coupling member may be arranged at an angle relative to the adjustment direction, i.e., the slanted face may extend in a direction which is not parallel to the adjustment direction. The contact face may be parallel to the adjustment direction. A normal vector of the contact face may be orthogonal to the adjustment direction.

The adjusting device may comprise a further coupling member which is moveably supported on the carrier and which has a further contact face shaped to abut on the abutment surface of the guide and a further slanted face. The coupling member and the further coupling member may be supported on the carrier such that they are independently moveable.

The coupling member and the further coupling member may be spaced from each other.

The coupling member and the further coupling member may be positioned on the carrier so as to be offset along a longitudinal axis of the abutment surface. The longitudinal axis of the abutment surface may correspond to the height direction along which the chair back height can be adjusted.

The contact face of the coupling member and the further contact face of the further coupling member may be parallel to each other.

Both the contact face of the coupling member and the further contact face of the further coupling member may abut on the abutment surface of the guide. The abutment surface may be located on one lateral side of the guide only. The coupling member and the further coupling member may be positioned on the same lateral side of the guide.

The abutment surface of the guide may define a plane. Both the contact face of the coupling member and the further contact face of the further coupling member may be positioned on the plane defined by the abutment surface. The contact face of the coupling member may be planar. The further contact face of the further coupling member may be planar.

The bias mechanism may comprise a wedge shaped to abut on the slanted face of the coupling member, and an energy storage mechanism coupled to the wedge to force the wedge into abutment with the slanted face of the coupling member. The energy storage mechanism may comprise at least one spring.

The wedge may be supported on the carrier so as to be moveable along a first direction. The first direction may be parallel to the adjustment direction.

The coupling member may be supported on the carrier so as to be moveable along a second direction transverse to the first direction. The second direction may be transverse to the adjustment direction.

The carrier may have a first channel along which the wedge is moveable and a second channel along which the coupling member is moveable. The first channel and the second channel may extend at an angle relative to each other. The first channel may extend along an axis which is parallel to the adjustment direction. The second channel may extend along an axis which is transverse to the adjustment direction.

When the adjusting device has the coupling member and the further coupling member, the bias mechanism may comprise a further wedge configured to abut on the further slanted face of the further coupling member.

The energy storage mechanism may be coupled to the further wedge to force the further wedge into abutment with the further slanted face of the further coupling member. The energy storage mechanism may comprise at least one spring. The energy storage mechanism may comprise a first spring coupled to the wedge and a second spring coupled to the further wedge.

The energy storage mechanism may apply a force onto the wedge and a further force onto the further wedge, the force and the further force being directed opposite to each other. The force and the further force may be anti-parallel.

The slanted face of the coupling member may extend at an angle of more than 0° and less than 20° relative to the adjustment direction. The slanted face of the coupling member may extend at an angle of more than 0° and less than 15° relative to the adjustment direction. The slanted face of the coupling member may extend at an angle of more than 0° and less than 10° relative to the adjustment direction.

The contact face of the coupling member may be an angled face. The abutment surface of the guide may be an angled surface. The contact face of the coupling member and the abutment surface of the guide may respectively be oriented such that, when the chair back height adjustment mechanism is installed in a seat, the contact face and the abutment surface are arranged at an angle relative to a plane which extends in the forward-rearward direction of the chair. The contact face and the abutment surface may respectively be inclined relative to the plane which extends in the forward-rearward direction by an angle of less than 90°. The contact face and the abutment surface may respectively be inclined relative to the plane which extends in the forward-rearward direction by an angle of about 45°. In other embodiments, the contact face of the coupling member and the abutment surface of the guide may respectively be oriented such that, when the chair back height adjustment mechanism is installed in a seat, the contact face and the abutment surface extend in the forward-rearward direction of the chair.

The chair back height adjustment mechanism may comprise a locking mechanism configured to lock the adjusting device at a plurality of positions along the guide. The locking mechanism may comprise a recess formed on one of the guide and the adjusting device, and a mating locking projection formed on the other one of the guide and the adjusting device. The locking mechanism may comprise a meandering recess formed on the guide. The meandering recess may form a closed path along which the mating locking projection travels. The meandering recess may be formed so as to be spaced from the abutment surface. The meandering recess may be formed on a face of the guide which, when the chair back height adjustment mechanism is installed in a chair, is arranged at the rear side of the chair. The locking mechanism may comprise a pin supported on the adjusting device, which is separate from the coupling member and, if present, the further coupling member. The pin may be engaged with the meandering recess. The locking mechanism may be configured to lock the adjusting device at a plurality of separate positions along the guide. This allows the user to adjust the height of the chair back in plural discrete steps by simply lifting the chair back. The locking mechanism may be configured such that, when the chair back height adjustment mechanism is installed in a chair, it prevents movement of the chair back to a lower position unless the chair back is raised to its uppermost position.

The chair back height adjustment mechanism may comprise a return mechanism coupled to the guide and the adjusting device to bias the adjusting device towards a rest position. The return mechanism may apply a force in the downward direction onto the adjusting device when the chair back height adjustment mechanism is installed in a chair. The return mechanism may comprise at least one energy storage element. The return mechanism may comprise a first energy storage element, e.g. a first spring, and a second energy storage element, e.g. a second spring. The first energy storage element and the second energy storage element may be offset from each other in a direction transverse to the adjustment direction. The first energy storage element and the second energy storage element may be arranged on opposite lateral sides of the guide. At least a portion of the first energy storage element and at least a portion of the second energy storage element may extend into the adjusting device.

The adjusting device may have a recess through which the guide extends. The coupling member and, if present, the further coupling member may be positioned at a lateral side of the recess.

The chair back may be attached to the adjusting device. The adjusting device may thus act as chair back carrier.

According to another embodiment, a chair is provided. The chair comprises a chair back and the chair back height adjustment mechanism of an embodiment.

The chair back may be attached to the adjusting device of the chair back height adjustment mechanism.

The guide may be attached to or integrally formed with a J-bar coupled to a base of the chair.

In the chair back height adjustment mechanism of embodiments, the coupling member is urged towards the abutment surface of the guide, thereby reducing or completely eliminating wobble. Lateral play between an inner face of the adjusting device and the outer lateral face of the guide may be reduced or eliminated. When a coupling member and a further coupling member are provided, play may be eliminated in a particular efficient manner. The coupling member and the further coupling member may respectively abut on different section of the abutment surface which are spaced from each other. The coupling member and the further coupling member may independently reduce lateral play at different locations offset along the adjustment direction. The return mechanism, if present, may bias the chair back into a lowest position. This may in particular be beneficial for lightweight chair backs to prepare a locking mechanism for a further displacement of the chair back.

The chair back height adjustment mechanism and chair according to embodiments may be utilized for various applications in which height adjustment for a chair back is desired. For illustration, the chair back height adjustment mechanism may be utilized in an office chair.

BRIEF DESCRIPTION OF DRAWINGS

Embodiments of the invention will be described with reference to the accompanying drawings in which like reference numerals refer to like elements.

DETAILED DESCRIPTION OF EMBODIMENTS

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise.

According to embodiments, a chair back height adjustment mechanism is provided. The chair back height adjustment mechanism comprises a guide and an adjusting device. The adjusting device may be displaced along the guide through a plurality of positions to set a height of the chair back. The chair back may be mounted to the adjusting device. The adjusting device comprises a carrier and a coupling member which is moveably supported on the carrier. A bias mechanism exerts a force onto the coupling member which urges a contact face of the coupling member against an abutment surface of the guide. Lateral play may thereby be reduced or eliminated. The adjusting device may comprise a further coupling member which is moveably supported on the carrier. The coupling member and the further coupling member may be offset from each other along an adjustment direction, which may correspond to the height direction in which the chair back is adjustable. The coupling member and the further coupling member may be independently moveable towards the abutment surface of the guide.

Figure 1:
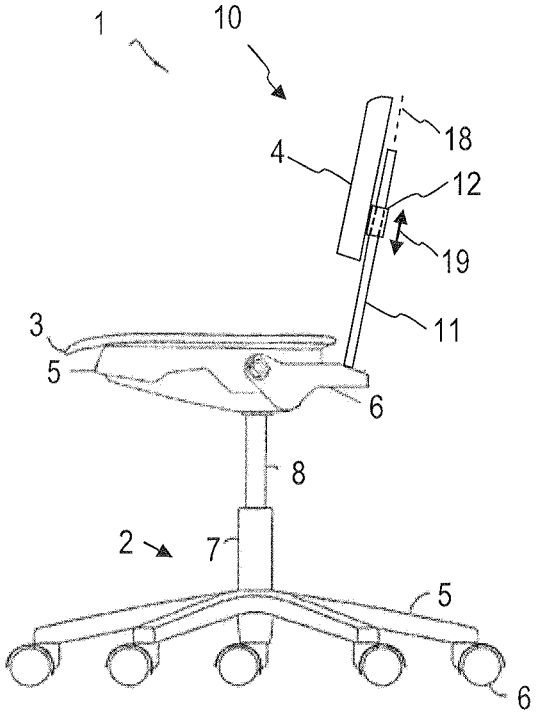
FIG. 1 is a schematic view of a chair having a chair back height adjustment mechanism according to an embodiment.

FIG. 1 shows a chair 1 which includes a chair back height adjustment mechanism 10 of an embodiment. The chair 1 is illustrated to be an office-type chair having a chair base assembly 2 and a superstructure. The superstructure includes a chair seat 3 and a chair back 4. The base assembly 2 may include a pedestal column 7, a number of support legs 5 extending radially from the column 7 and a corresponding number of castors 6 operably supported on the outer ends of the support legs 5. Additionally, a gas cylinder 8 or other lifting mechanism may be supported by the column 7 to enable the height of the seat 3, and thus of the chair superstructure, to be adjusted by an occupant. The chair 1 may optionally include a tilt mechanism, which may be operative to implement a coordinated motion of the seat 3 and of the chair back 4 when the chair back 4 is tilted. The tilt mechanism may comprise a bracket 6 to which the chair back is mounted and a bracket 5 to which the seat is mounted.

It should be understood that the terms "forward", "rearward", "lateral", "left" and "right" as used herein, each have a particular meaning that is defined in relation to a flat support surface beneath the chair 1 (e.g., parallel to a floor on which castors 6 rest) and in relation to an occupant of the chair. For instance, the term "forward" refers to a direction moving away from the chair back 4 and in front of a chair occupant along an axis which extends parallel to such a flat support surface, while the term "rearward" refers to a direction opposite of the forward direction. The term "lateral" refers to a generally horizontal direction perpendicular to both the forward and rearward direction and extending parallel to the aforementioned flat support surface.

The chair 1 includes a height adjustment mechanism 10. The height adjustment mechanism 10 is operative to allow the height of the chair back 4 to be adjusted. The height adjustment mechanism 10 comprises a guide 11 and an adjusting device 12. The adjusting device 12 may be a chair back carrier. The chair back 4 may be attached to the adjusting device 11, e.g. by bolts, screws, or other attachment means. A movement 19 of the adjusting device 12 along the guide 11 may be brought about by a user action. For illustration, the user may exert a force onto the chair back 4 to raise or lower the chair back 4 by displacing the adjusting device 12 along the guide 11. Thereby, the chair back 4 may be displaced along an adjustment direction 18, which may correspond to a longitudinal axis of the guide 11. The guide 11 may comprise or may be attached to a J-bar which protrudes towards a rear side of the seat 3.

As will be described in more detail with reference to FIG. 2 to FIG. 14, the chair back height adjustment mechanism 10 is configured such that wobble of the adjusting device 12 relative to the guide 11 is reduced or eliminated. To this effect, the adjusting device 12 comprises a coupling member which is urged against an abutment surface at a lateral side of the guide 11. The coupling member is moveably supported on a carrier of the adjusting device 12 and may have a slanted face. A wedge may abut on the slanted face to urge the coupling member into abutment with the abutment surface of the guide 11.

Figure 2:
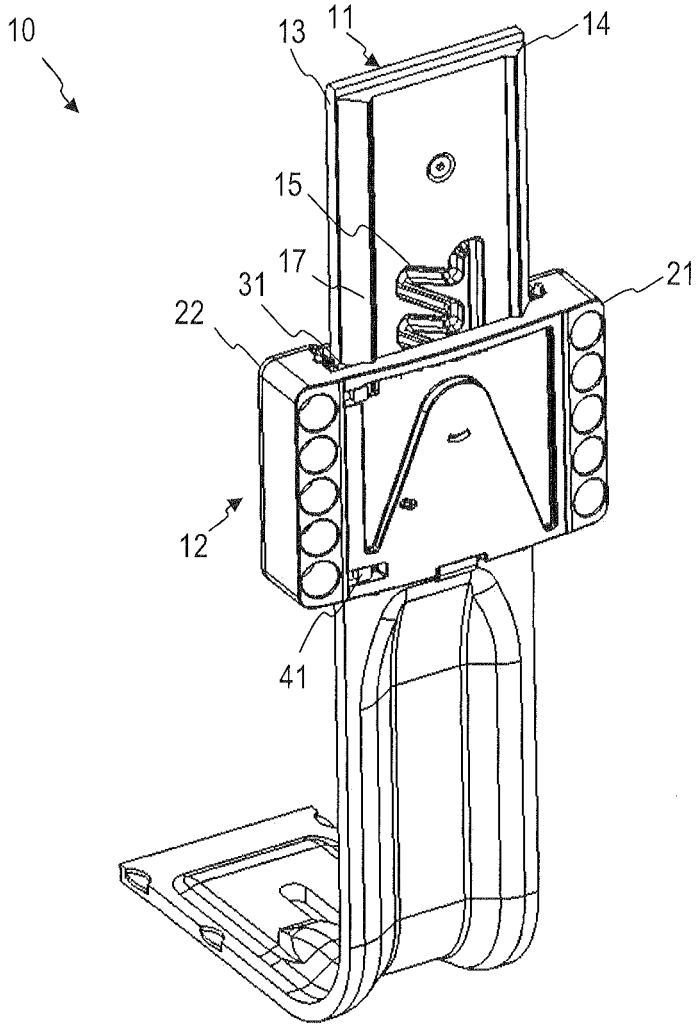
FIG. 2 is a perspective view of a chair back height adjustment mechanism according to an embodiment.
Figure 3:
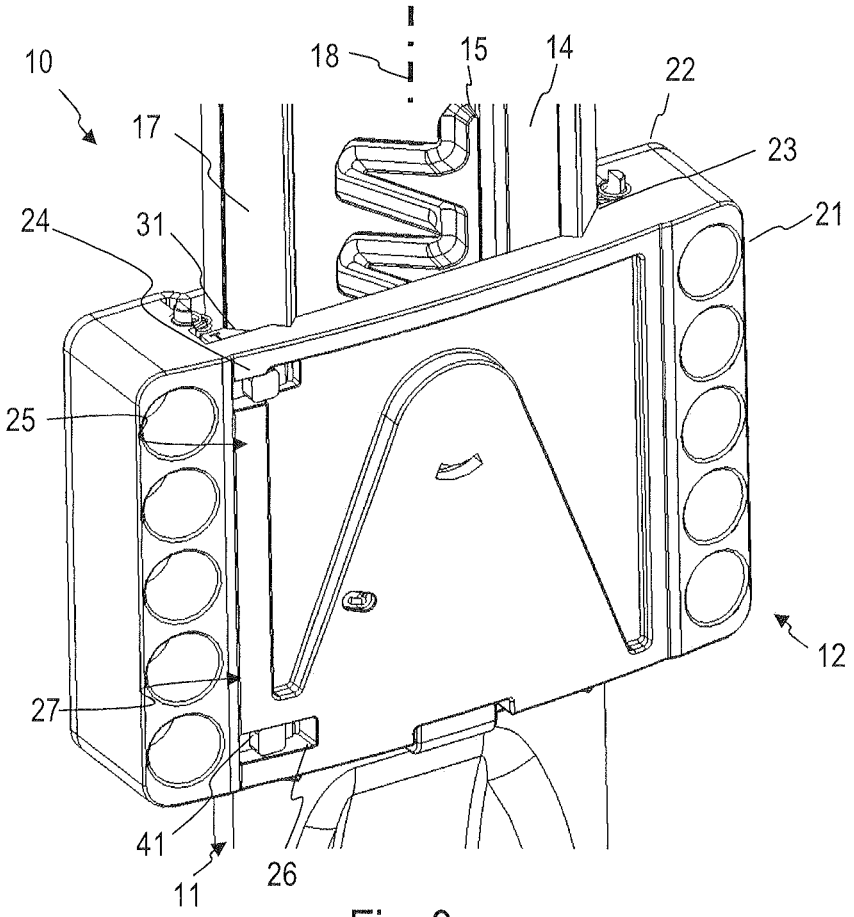
FIG. 3 is a perspective detail view of the chair back height adjustment mechanism of FIG. 2.
Figure 7:
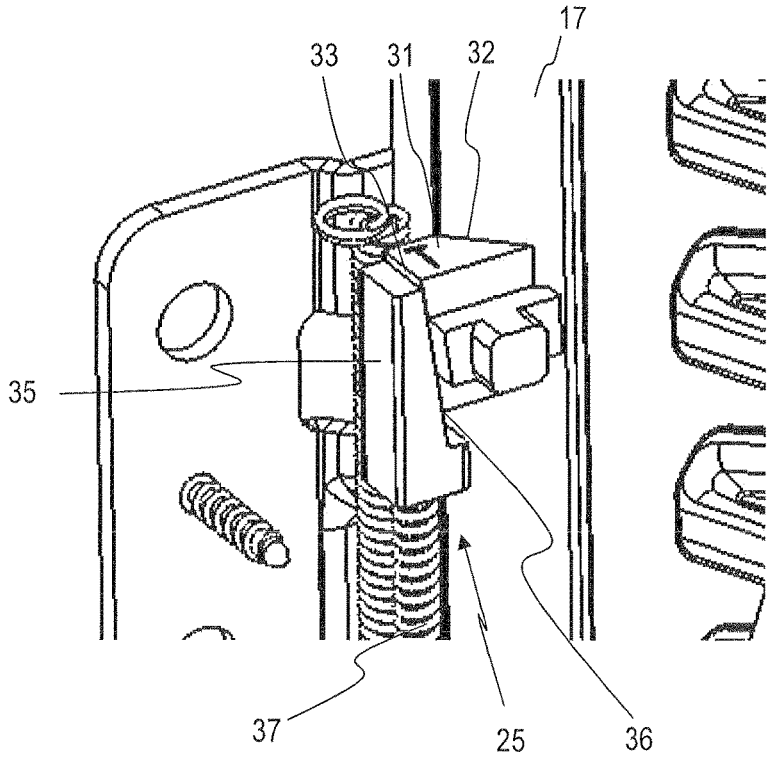
FIG. 7 is an enlarged perspective view of the chair back height adjustment mechanism of FIG. 2.
Figure 8:
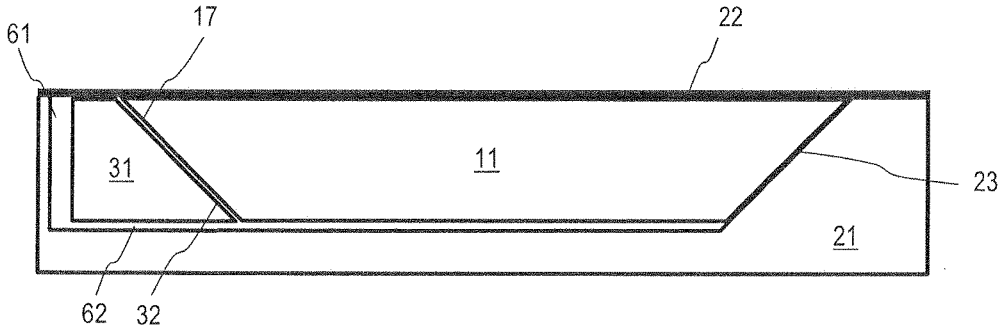
FIG. 8 is a cross-sectional view of the chair back height adjustment mechanism of FIG. 2 in a plane perpendicular to an adjustment direction.
Figure 9:
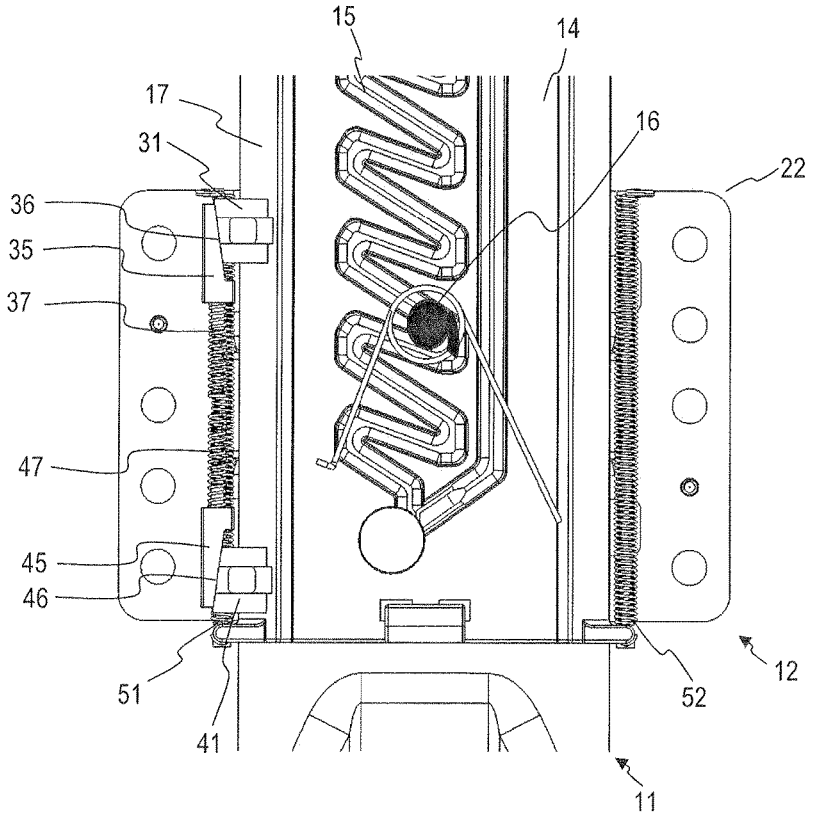
FIG. 9 is a plan view of the chair back height adjustment mechanism of FIG. 2 with part of an adjusting device removed.

FIG. 2 is a perspective view of a chair back height adjustment mechanism 10 of an embodiment. FIG. 3, FIG. 4, FIG. 5 and FIG. 6 are detail views of the chair back height adjustment mechanism 10, with part of an adjusting device being removed in FIG. 4 and FIG. 6. FIG. 7 is an enlarged view of the chair back height adjustment mechanism 10. FIG. 8 is a cross-sectional view of the chair back height adjustment mechanism 10 taken in a plane perpendicular to an adjustment direction. FIG. 9 is a plan view of the chair back height adjustment mechanism 10 with part of an adjusting device removed. The chair back height adjustment mechanism 10 may be installed in a chair 1. An adjustment direction 18 may be defined by a longitudinal axis of the guide and may define a height direction in which the chair back is adjustable.

Referring to FIG. 2, the chair back height adjustment mechanism 10 comprises a guide 11 and an adjusting device 12 displaceably supported thereon. The guide 11 may be composed of several members, such as a first member 13 and a second member 14 attached thereto. The first member 13 may be made from a high strength material, e.g. steel. The first member 13 may be shaped as a J-bar. The second member 14 may interact with the adjusting device 12 to guide the adjusting device 12 on the guide 11 with little wobble. Further, the second member 14 may be provided with a recess 15 which interacts with a projection supported on the adjusting device 12 to lock the adjusting device 12 in a plurality of positions on the guide 11. This allows the user to click the adjusting device 12 through a plurality of discrete locations, thereby setting the height in a step-wise manner, for example.

When the chair back height adjustment mechanism 10 is installed in the chair, the chair back may be attached to the adjusting device 12. The adjusting device 12 may have attachment features, such as bolt holes, for attachment of the chair back. The adjusting device 12 may act as chair back carrier. The adjusting device 12 may be a cartridge. The adjusting device 12 may have a recess through which the guide 11 extends. The recess may be configured as a cavity defined by the adjusting device 12. The cavity may extend from a first opening in an upper end face of the adjusting device 12 to a second opening in a lower end face of the adjusting device 12. The recess through which the guide 11 extends may be defined between a carrier 21 and closure member 22 attached thereto. The closure member 22 may be a plate. The plate may be formed from metal. The carrier 21 and closure member 22 may define an outer shell of the adjusting device. The carrier may be molded from a plastic material. Other configurations may be used. For illustration, the carrier 21 and closure member 22 may be integrally formed.

As will be explained in more detail with reference to FIG. 3 to FIG. 14, the adjusting device 12 has at least one coupling member 31 which is supported on the adjusting device 12 so as to be moveable transverse to the adjustment direction 18. The coupling member 31 is biased towards an abutment surface 17 of the guide 11 such that a contact face of the coupling member 31 abuts on the abutment surface 17 on the lateral side of the guide 11. Lateral wobble may be reduced. As shown in FIG. 2, the abutment surface 17 and the contact face of the coupling member 31 may respectively have a normal vector which extends at an angle relative to the lateral, i.e. left-right, direction. I.e., the abutment surface 17 and the contact face of the coupling member 31 may be angled surfaces, which extend at an angle relative to a vertical plane which extends in the forward-rearward direction. This allows both lateral wobble and wobble in the forward-rearward direction to be reduced or eliminated.

Referring now to FIG. 3, FIG. 4, FIG. 5, FIG. 6 and FIG. 7, the guide 11 has an abutment surface 17 at a lateral side. The abutment surface 17 may extend parallel to a longitudinal axis of the guide 11, i.e., along the adjustment direction 18. The abutment surface 17 may, but does not need to be angled. The adjusting device 12 has an inner face 23 on which a side of the guide 11 abuts. The inner face 23 may have a position which is fixed relative to the carrier 21. The inner face 23 may be formed on the carrier 21, for example. The inner face 23 may define a lateral side of the recess through which the guide 11 extends.

On the opposite lateral side of the guide 11, the adjusting device 12 has a coupling member 31. The coupling member 31 is supported on the carrier 21 so as to be moveable relative thereto. The coupling member 31 may be supported on the carrier 21 so as to be moveable relative to the carrier 21 in a direction transverse to the longitudinal axis of the guide 11. The coupling member 31 may be supported on the carrier so as to be moveable relative to the carrier 21 in a direction which corresponds to the lateral (left-right) direction when the chair back height adjustment mechanism 10 is installed in a chair. To this end, a channel 24 may be formed on the carrier 21. The coupling member 31 may be moveably supported in the channel 24. A nose of the coupling member may be slideably received in the channel 24. The channel 24 and the coupling member 31 may be configured such that the channel 24 allows the coupling member 31 to move in a direction transverse to the longitudinal axis of the guide 11 but prevents movement of the coupling member 31 relative to the carrier 21 in a direction along the adjustment direction 18. The channel 24 may extend along an axis which is transverse to the longitudinal axis of the guide 11 and which corresponds to the lateral direction when the chair back height adjustment mechanism 10 is installed in a chair. The coupling member 18 moves together with the carrier when the adjusting device 12 is displaced on the guide 11 along the adjustment direction 18 defined by the longitudinal axis of the guide. At least lateral play between the adjusting device 12 and the guide 11 may be reduced or eliminated by biasing the coupling member 31 into abutment with the guide 11.

The coupling member 31 has a contact face 32 which is urged into abutment with the abutment surface 17 of the guide 11. The contact face 32 of the coupling member 31 and the abutment surface 17 of the guide 11 may be parallel to each other. The contact face 32 and the abutment surface 17 may respectively be planar. The contact face 32 and the abutment surface 17 may respectively have a normal vector which is angled relative to the lateral direction. A bias mechanism may be provided on the adjusting device 12 to urge the contact face 32 of the coupling member 31 into abutment with the abutment surface 17.

The bias mechanism may comprise a wedge 35 and an energy storage mechanism. The energy storage mechanism may comprise a spring 37. The carrier 21 may have a channel 25 in which the wedge 35 is moveably supported. The channel 25 may generally extend parallel to the longitudinal axis of the guide 11, i.e., transverse to the channel 24. The energy storage mechanism forces the wedge 35 against the coupling member 31. The spring 37 may act on the wide base of the wedge 35. This urges the coupling member 31 towards the abutment surface 17. The wedge 35 has a slanted face 36 which is inclined to match a slanted face 33 of the coupling member 31. The slanted face 33 of the coupling member 31 and the slanted face 36 of the wedge 35 may extend parallel to each other. The slanted face 33 of the coupling member 31 and the slanted face 36 of the wedge 35 may respectively be inclined relative to the longitudinal axis 18 of the guide 11. The slanted face 33 and the contact face 32 may be non-adjacent faces of the coupling member 31.

A further coupling member 41 may be supported on the adjusting device 12. The further coupling member 41 may have a configuration and operation as explained for the coupling member 31. The further coupling member 41 may comprise a contact face 42 shaped to abut on the abutment surface 17. The further coupling member 41 may have a slanted face 43 on which a slanted face 46 of a further wedge 45 abuts. The bias mechanism may comprise a further spring 47 which forces the further wedge 45 against the further coupling member 41. Due to the inclination of the slanted faces of the further wedge 45 and the further coupling member 41, the further coupling member 41 is thereby pushed against the abutment surface 17.

The carrier 21 may have a channel 26 in which the further coupling member 41 may be moveably supported. The channel 26 may extend parallel to channel 24 and transverse to the longitudinal axis 18 of the guide. The channel 26 and the further coupling member 41 may be configured such that the channel 26 allows the further coupling member 41 to move relative to the carrier 21 in a direction transverse to the longitudinal axis of the guide 11 but prevents movement of the further coupling member 41 relative to the carrier 21 in a direction parallel to the displacement direction 18. The carrier 21 may have a channel 27 in which the further wedge 45 is moveably supported. The channel 27 may generally extend parallel to the longitudinal axis of the guide 11, i.e., along the adjustment direction 18 and transverse to the channel 26.

The coupling member 31 and the further coupling member 41 may be offset from each other along the longitudinal axis of the guide 11. The coupling member 31 and the further coupling member 41 may be provided on opposite ends (upper and lower ends) of the adjusting device 12.

The bias mechanism may bias the wedge 35 and the further wedge 45 in opposite directions, i.e. away from each other. The wedge 35 and the further wedge 45 may be independently moveable. Two independent springs or other energy storage mechanisms may be used to apply forces onto the wedge 35 and the further wedge 45. In other embodiments, one spring may bias the wedge 35 and the further wedge 45 away from each other. The inclination of the slanted faces of the wedge 35 and further wedge 45 and the inclination of the slanted faced of the coupling member 31 and further coupling member 41 abutting thereon ensure that the wedges 35, 45 push the coupling members 31, 41 against the abutment surface 17 of the guide 11.

The adjusting device 12 may be configured such that the coupling member 31 and the further coupling member 41 may be independently moveable. This allows play to be reduced or eliminated in an efficient manner, even when the width of the guide 11 varies along its longitudinal axis 18, for example, or when the adjusting device 12 twists relative to the guide 11.

FIG. 8 is a cross-sectional view of the adjusting device. The drawing plane of FIG. 8 is orthogonal to the longitudinal axis of the guide 11. The bias mechanism urges the coupling member 31 against the abutment surface 17 of the guide 11. This reduces or eliminates lateral play between the adjusting device 12 and the guide 11. Varying width of the guide 11 may be compensated by providing a space 61 outwardly of the coupling member 31, into which the coupling member 31 may be displaced when the width of the guide 11 is larger. The wedge 35 (not shown in FIG. 8) is pushed out of the space 61 to make room for the coupling member 31 as required to compensate for a larger width of the guide 11. Lateral sides of the guide 11 are sandwiched between the contact face 32 of the coupling member 31, which can be displaced relative to the carrier, and the fixed face 23 of the carrier 21.

The abutment surface 17 of the guide 11 and the mating contact face 32 of the coupling member 31 may respectively be inclined relative to the forward-rearward direction. The abutment surface 17 of the guide 11 and the mating contact face 32 of the coupling member 31 may respectively be inclined at an angle of 45°, for example, relative to the forward-rearward direction. This allows not only lateral wobble, but also wobble in the forward-rearward direction to be reduced or eliminated.

Figure 4:
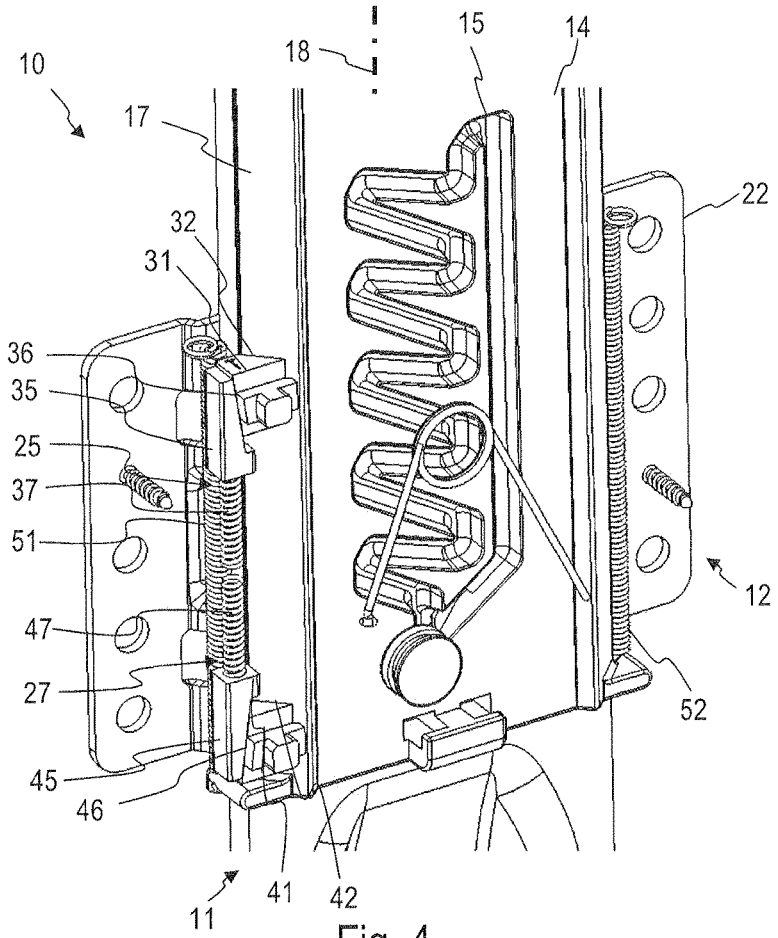
FIG. 4 is a perspective detail view of the chair back height adjustment mechanism as in FIG. 3 with part of an adjusting device removed.
Figure 5:
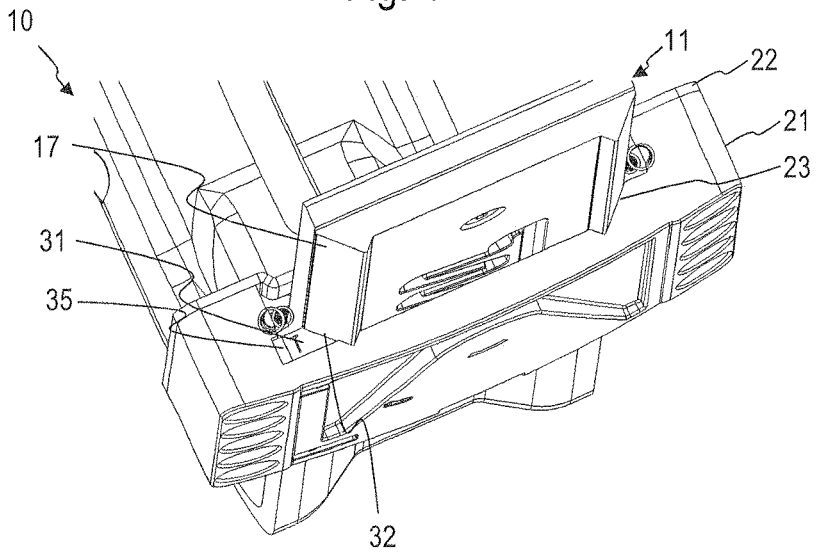
FIG. 5 is another perspective detail view of the chair back height adjustment mechanism of FIG. 2.
Figure 6:
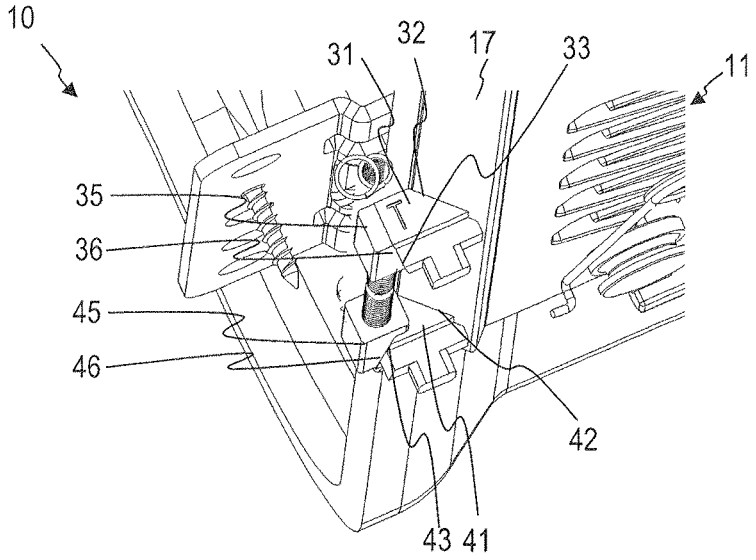
FIG. 6 is a perspective detail view of the chair back height adjustment mechanism as in FIG. 5 with part of an adjusting device removed.

Referring to FIG. 4 and FIG. 9, the adjusting device 12 and guide 11 may be provided with a locking mechanism which locks the adjusting device 12 in a plurality of different positions on the guide 11. Various implementations of the locking mechanism may be used. For illustration, the guide 11 may have a meandering recess 15. The meandering recess 15 may comprise plural meanders which extend on a face of the guide 11 which, in the installed state, is located at a rear side of the chair. The meandering recess 15 may define a closed path. A projection 16 (schematically shown in FIG. 9) may be provided on the adjusting device 12 and may be engaged with the meandering recess 15. The projection 16 may be biased by a spring. The locking mechanism may be operative to lock the adjusting device 12 in a plurality of different separate positions on the guide 11. The locking mechanism may be configured such that a small downward force must act on the adjusting device 12 after each upward movement step before the adjusting device 12 may be further advanced in the height direction.

Referring to FIG. 4 and FIG. 9, a return mechanism may be provided which automatically applies such a downward force onto the adjusting device 12 to bring the locking mechanism into a state in which the adjusting device 12 may be moved in an upward direction without requiring the user to first slightly push the chair back 4 or adjusting device 12 in a downward direction. The return mechanism may comprise at least one spring. The return mechanism may comprise a pair of springs 51, 52. The spring(s) 51, 52 of the return mechanism may respectively be coupled to the adjusting device 12 and the guide 11. The springs 51, 52 of the return mechanism may be provided on opposite lateral sides of the guide 11. The springs 51, 52 may cause the adjusting device 12 to perform a small downward movement after the user has set the adjusting device 12 to a higher position, thereby preparing the locking mechanism 15, 16 for the next upward movement step.

While certain configurations of the abutment surface and of coupling members are shown in FIG. 3 to FIG. 9, other configurations may be used in other embodiments. For illustration, the abutment surface 17 of the guide 11 does not need to be an angled surface, but may extend in a forward-rearward direction. Accordingly, the contact face 32 of the coupling member 31 may also extend in a plane in the forward-rearward direction.

Figure 10:
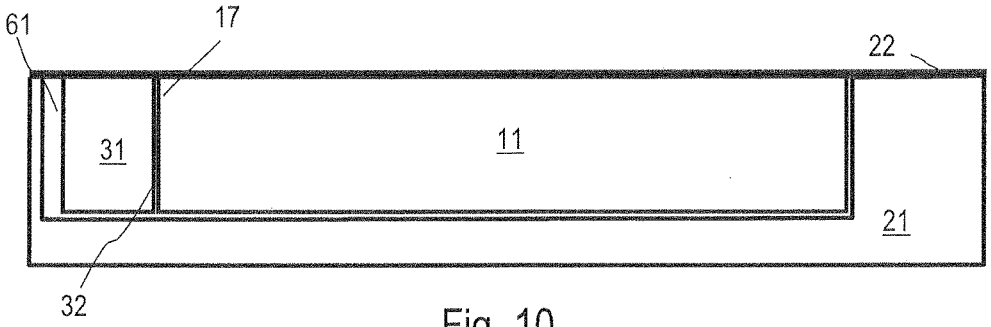
FIG. 10 is a cross-sectional view of the chair back height adjustment mechanism of another embodiment in a plane perpendicular to an adjustment direction.

FIG. 10 is a cross-sectional view of a chair back height adjustment mechanism according to another embodiment. The drawing plane of FIG. 10 corresponds to a plane orthogonal to the longitudinal axis 18 of the guide 11. In the chair back height adjustment mechanism of FIG. 10 the abutment surface 17 of the guide 11 extends in a plane in the forward-rearward direction. The contact face 32 of the coupling member 31 also extends in a plane in the forward-rearward direction. Such a configuration also allows lateral wobble to be eliminated. To this end, the contact face 32 of the coupling member 31 is urged into abutment with the abutment surface 17 of the guide 11. When the width of the guide 11 varies, the coupling member 31 may be pushed into the space 61. The wedge 35 (not shown in FIG. 10) may be pushed out of this space to make room for the coupling member 31, thereby accommodating varying widths of the guide 11. The configuration of the slanted face of the coupling member 31 and of the wedge interacting therewith is the same as explained with reference to FIG. 2 to FIG. 9.

In the chair back height adjustment mechanism 10 of embodiments, the coupling member(s) 31, 41 moveably supported on the carrier have a slanted face. A wedge 35, 45 of the bias mechanism may respectively abut on this slanted face. The inclination of the slanted face of the coupling member(s) 31, 41 and the inclination of the slanted face of the wedge(s) 35, 45 may be such that the angle between the slanted face and the longitudinal axis of the guide 11 is shallow. In this case, a small force from the bias mechanism may push the coupling member(s) 31, 41 against the abutment surface 17. On the other hand, due to the shallow angle, a force from the guide 11 onto the coupling member(s) 31, 41 is unlikely to bring the coupling member(s) 31, 41 out of contact with the abutment surface 17.

Figure 11:
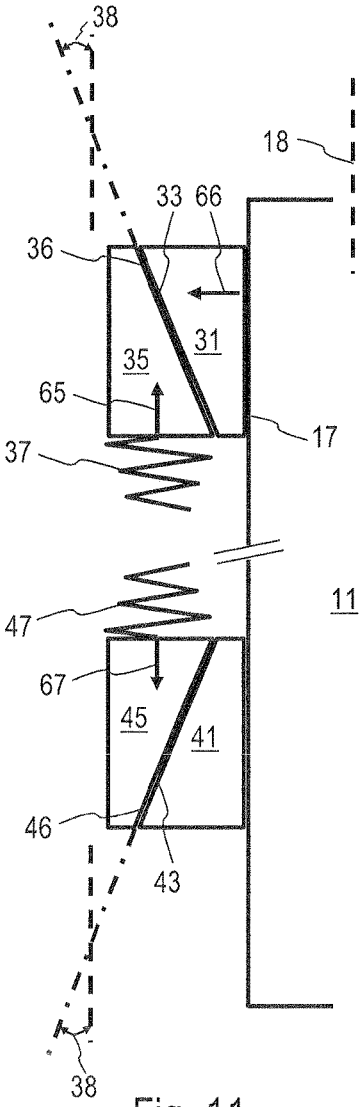
FIG. 11 is a cross-sectional view of the chair back height adjustment mechanism of FIG. 2 in a plane parallel to an adjustment direction.

FIG. 11 is a cross-section view of the chair back height adjustment mechanism 10 of an embodiment. The cross-sectional view is taken in a plane along the longitudinal axis of the guide 11 and which extends in the lateral, i.e. left-right, direction.

The slanted face 33 of the coupling member 31 and the slanted face 36 of the wedge 35 are respectively inclined by an angle 38 relative to the longitudinal axis 18 of the guide 11. The angle 68 between the longitudinal axis 18 of the guide and the slanted face 33 of the coupling member 31 may be greater than 0° and less than 20°. The angle 38 may be greater than 0° and less than 15°. The angle 38 may be greater than 0° and less than 10°. The angle 38 may be greater than 0° and less than or equal to 8°. Such configurations allow the coupling member 31 to be pushed against the abutment surface 17 of the guide 11 by a force 65 applied by the spring 37 onto the wedge 35. An undesired displacement of the coupling member 31 away from the abutment surface 37 may be prevented by the shallow angle 38, even when a force 66 is exerted onto the coupling member 31 by the guide 11.

The further slanted face 43 of the further coupling member 41 and the slanted face 46 of the further wedge 45 may also be inclined by an angle 38 relative to the longitudinal axis 18 of the guide 11. The angle 38 may also be greater than 0° and less than 20°. The angle 38 may be greater than 0° and less than 15°. The angle 38 may be greater than 0° and less than 10°. The angle 38 may be greater than 0° and less than or equal to 8°. As schematically shown in FIG. 11, the wedge 35 and the further wedge 45 may taper in opposite directions. For illustration, the larger bases of the two wedges 35, 45 may face each other. Similarly, the coupling member 31 and the further coupling member may taper in opposite directions. For illustration, the smaller bases of the coupling member 31 and the further coupling member 41 may be arranged so as to face each other.

Other configurations of coupling member(s) and bias mechanisms may be used in other embodiments. For illustration, the embodiments explained in detail with reference to FIG. 2 to FIG. 11 respectively have a plurality of coupling members, with a moveable wedge respectively abutting on a slanted face of the coupling member. In other embodiments, the wedge(s) which abut on the slanted face(s) of the coupling member(s) do not have to be displaceable, but may be provided at a fixed location on the carrier 21.

Alternatively or additionally, the contact face(s) provided for abutment on the abutment surface 17 of the guide 11 may be formed on one coupling member which is displaceable in a lateral direction and, optionally, also in a direction parallel to the adjustment direction.

Figure 12:
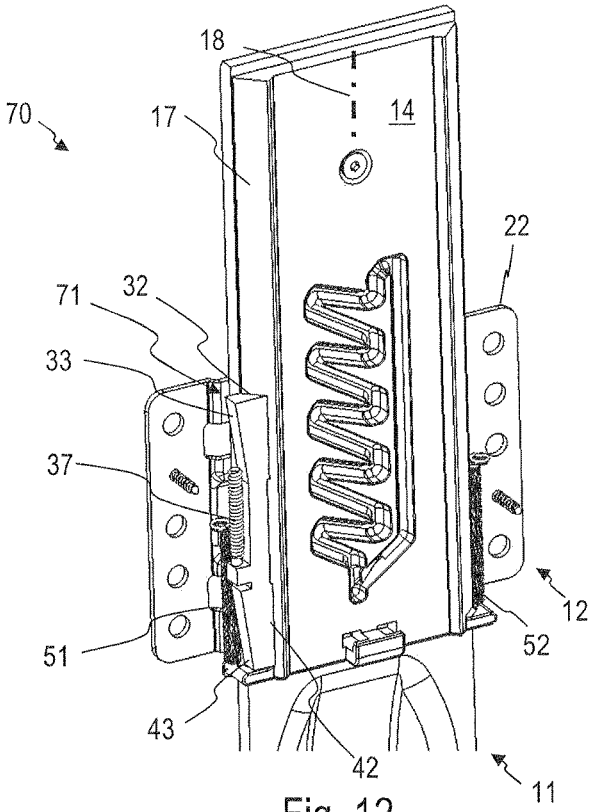
FIG. 12 is a partially broken-away perspective view of a chair back height adjustment mechanism of another embodiment.
Figure 13:
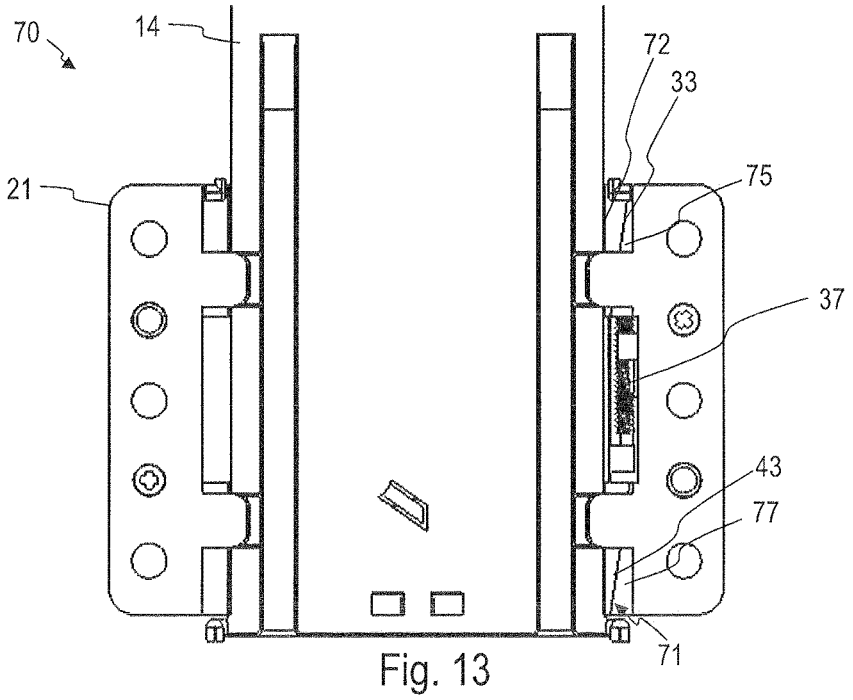
FIG. 13 is a partially broken-away plan view of the chair back height adjustment mechanism of FIG. 12.
Figure 14:
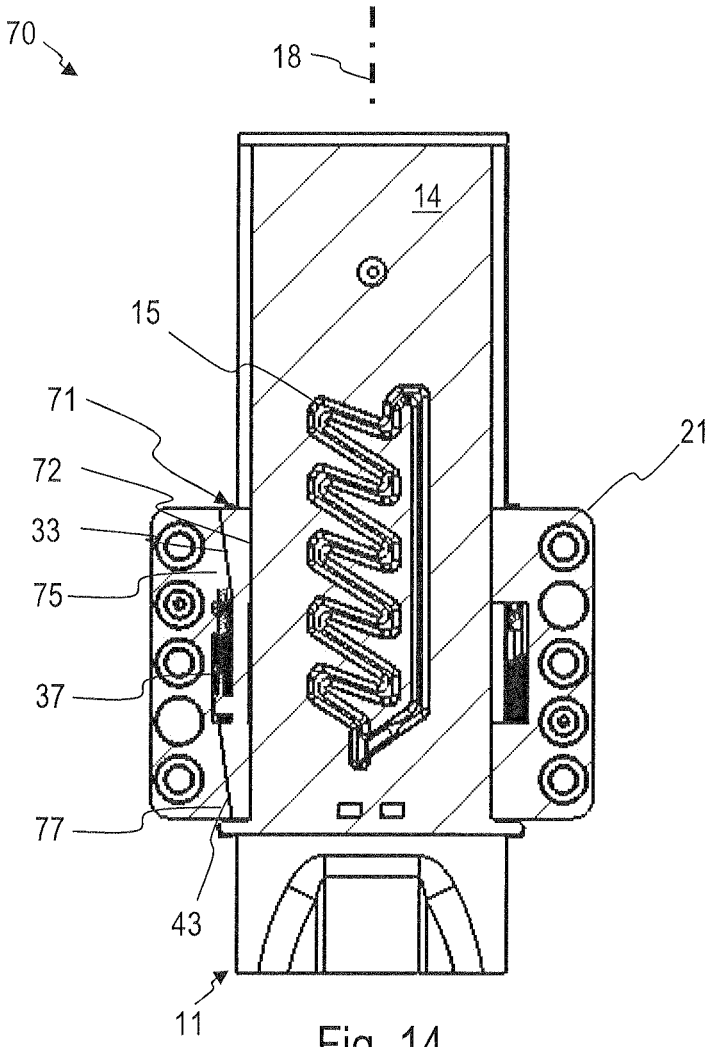
FIG. 14 is a cross-section view of the chair back height adjustment mechanism of FIG. 12 in a plane parallel to an adjustment direction.

With reference to FIG. 12 to FIG. 14, a chair back height adjustment mechanism 70 according to another embodiment will be described. FIG. 12 is a perspective view of the chair back height adjustment mechanism 70 with the carrier 21 removed. FIG. 13 is a plan view from a front side with a closure member 22 removed from the carrier 21. FIG. 14 is a cross-sectional view of the chair back height adjustment mechanism 70.

The chair back height adjustment mechanism 70 has a guide 11 and an adjusting device 12 displaceably supported on the guide 11. The adjusting device 12 comprises a carrier 21 on which a coupling member 71 is supported so as to be moveable in a lateral direction. The coupling member 71 may also be displaceable in a direction parallel to the longitudinal axis 18 of the guide 11.

The coupling member 71 has a contact face 72 which is shaped to abut on the abutment surface 17 of the guide 11. The contact face 72 may be parallel to the abutment surface 17. The contact face 72 and the abutment surface 17 may be angled relative to the forward-rearward direction to reduce or eliminate wobble both in the lateral direction and in the forward-rearward direction. A normal vector of the contact face 72 and of the abutment surface 17 may enclose an angle with the left-right direction.

The coupling member 71 has a first slanted face 33 and a second slanted face 43. The first slanted face 33 and the second slanted face 43 may be parallel to each other. The first slanted face 33 and the second slanted face 43 may respectively be inclined relative to the longitudinal axis of the guide 11 by an angle which may be less than 20°. The angle may be greater than 0° and less than 15°. The angle may be greater than 0° and less than 10°. The angle may be greater than 0° and less than or equal to 8°.

The carrier 21 has a first wedge 75 and a second wedge 76, which may be integrally formed on the carrier 21. The first wedge 75 has a first slanted face parallel to and abutting on the slanted face 33 of the coupling member 71. The second wedge 77 has a second slanted face parallel to and abutting on the further slanted face 43 of the coupling member.

An energy storage mechanism, e.g. a spring 37, may be coupled to the coupling member 71. The energy storage mechanism may push the slanted face 33 of the coupling member 71 against the first wedge 75 and the further slanted face 45 of the coupling member 71 against the second wedge 77. This pushes the coupling member such that the contact face 72 abuts on and pushes against the abutment surface 17 of the guide 11.

Similarly to the operation of the chair back height adjustment mechanism explained with reference to FIG. 2 to FIG. 11, the coupling member 71 is pushed into abutment with the abutment surface 17 of the guide 11. The play between the adjusting device 12 and the guide 11 may thereby be reduced or eliminated.

The chair back height adjustment mechanism 70 of FIG. 12 to FIG. 14 may also have a locking mechanism. The locking mechanism may comprise a meandering track 15 on the guide 11. The locking mechanism may comprise a projection on the adjusting device 12 which is engaged with the meandering track 15. The locking mechanism may be configured such that a downward force is required after an upward movement of the adjusting device 12, so as to prepare the locking mechanism for the next upward movement. The chair back height adjustment mechanism may comprise a return mechanism having one or plural spring(s) 51, 52. The return mechanism may be operative to exert a downward force onto the adjusting device and to thereby prepare the locking mechanism such that the adjusting device 12 may be further advanced on the guide 11 in an upward direction.

While chair back height adjustment mechanisms according to embodiments have been described in detail with reference to the drawings, modifications thereof may be implemented in further embodiments. For illustration, additional mechanisms may be integrated into or coupled to the chair back height adjustment mechanism to implement additional functionalities.

For further illustration, while chair back height adjustment mechanisms have been described in which a bias mechanism comprises a moveable wedge which is pushed against a slanted face of a coupling member, the bias mechanism may also push the slanted face of the coupling member against a slanted face which is integrally formed on the carrier.

For further illustration, while chair back height adjustment mechanisms have been described in which coupling member(s) are provided on one side of the guide to accommodate variations in width and/or thickness of the guide, moveable coupling members may also be arranged on the opposite lateral sides of the guide.

While exemplary embodiments have been described in the context of office-type chairs, chair back height adjustment mechanisms and chairs according to embodiments of the invention are not limited to this particular application. Rather, embodiments of the invention may be employed to effect a height adjustment of a chair back in a wide variety of chairs.

The invention claimed is:

1. A chair back height adjustment mechanism, comprising:

a guide having an outer abutment surface at a lateral side of the guide, the abutment surface extending along an adjustment direction; and an adjusting device, configured to be coupled to a chair back, and supported on the guide so as to be displaceable along the adjustment direction, the adjusting device comprising:

(1) a carrier, (2) a coupling member which is moveably supported on the carrier, the coupling member having a contact face shaped to abut on the abutment surface of the guide and a slanted face, and (3) a bias mechanism operative to apply a force onto the slanted face to urge the contact face of the coupling member against the abutment surface of the guide;

wherein the bias mechanism comprises:

a wedge shaped to abut on the slanted face of the coupling member, and an energy storage mechanism operative to force the wedge and the slanted face of the coupling member into abutment.

2. The chair back height adjustment mechanism of claim 1, wherein the adjusting device comprises a further coupling member which is moveably supported on the carrier, the further coupling member having a further contact face shaped to abut on the abutment surface of the guide and a further slanted face.

3. The chair back height adjustment mechanism of claim 2, wherein the coupling member and the further coupling member are spaced from each other.

4. The chair back height adjustment mechanism of claim 2, wherein the coupling member and the further coupling member are positioned on the carrier so as to be offset along a longitudinal axis of the guide.

5. The chair back height adjustment mechanism of claim 2, wherein the contact face of the coupling member and the further contact face of the further coupling member are parallel to each other.

6. The chair back height adjustment mechanism of claim 1, wherein the wedge is supported on the carrier so as to be moveable along a first direction, and wherein the coupling member is supported on the carrier so as to be moveable along a second direction transverse to the first direction.

7. The chair back height adjustment mechanism of claim 1, wherein the carrier has a first channel along which the wedge is moveable and a second channel along which the coupling member is moveable, the first channel being parallel to the adjustment direction and the second channel being transverse to the adjustment direction.

8. The chair back height adjustment mechanism of claim 2, wherein the bias mechanism comprises a further wedge configured to abut on the further slanted face of the further coupling member, wherein the energy storage mechanism is coupled to the further wedge to force the further wedge into abutment with the further slanted face of the further coupling member.

9. The chair back adjust mechanism of claim 8, wherein the energy storage mechanism applies a force onto the wedge and a further force onto the further wedge, the force and the further force being antiparallel.

10. The chair back height adjustment mechanism of claim 1, wherein the slanted face of the coupling member extends at an angle of more than 0° and less than 20° relative to the adjustment direction.

11. The chair back height adjustment mechanism of claim 1, wherein the contact face of the coupling member is an angled face.

12. A chair back height adjustment mechanism, comprising:

a guide having an outer abutment surface at a lateral side of the guide, the abutment surface extending along an adjustment direction; and an adjusting device, configured to be coupled to a chair back, and supported on the guide so as to be displaceable along the adjustment direction, the adjusting device comprising:

(1) a carrier, (2) a coupling member which is moveably supported on the carrier, the coupling member having a contact face shaped to abut on the abutment surface of the guide and a slanted face, and (3) a bias mechanism operative to apply a force onto the slanted face to urge the contact face of the coupling member against the abutment surface of the guide; and a return mechanism coupled to the guide and the adjusting device to bias the adjusting device towards a rest position.

13. A chair, comprising:

a chair back, and the chair back height adjustment mechanism of claim 1, wherein the chair back is attached to the adjusting device of the chair back height adjustment mechanism.

14. The chair of claim 13, wherein the guide is attached to or integrally formed with a J-bar coupled to a base of the chair.

15. A chair, comprising:

a chair back, and the chair back height adjustment mechanism of claim 12, wherein the chair back is attached to the adjusting device of the chair back height adjustment mechanism.

16. The chair of claim 15, wherein the guide is attached to or integrally formed with a J-bar coupled to a base of the chair.

* * * * *